US006698254B2

(12) United States Patent
Bolduan et al.

(10) Patent No.: US 6,698,254 B2
(45) Date of Patent: Mar. 2, 2004

(54) AUTOMATICALLY CONTROLLED WASHING MACHINE WITH OVERFLOW PROTECTION

(75) Inventors: Edwin Bolduan, Berlin (DE); Harald Moschütz, Grossbeeren (DE); Horst Wiemer, Kleinmachnow (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/171,696

(22) Filed: Jun. 14, 2002

(65) Prior Publication Data

US 2002/0178764 A1 Dec. 5, 2002

Related U.S. Application Data

(63) Continuation of application No. PCT/EP00/11040, filed on Nov. 8, 2000.

(30) Foreign Application Priority Data

Dec. 14, 1999 (DE) ..... 199 60 265

(51) Int. Cl.[7] ..... D06F 33/02
(52) U.S. Cl. ..... 68/12.02; 68/12.19; 68/207
(58) Field of Search ..... 68/12.02, 12.19, 68/12.21, 58, 207

(56) References Cited

U.S. PATENT DOCUMENTS 3,729,051 A * 4/1973 Mannion et al.
4,390,126 A * 6/1983 Buchholz et al.
4,468,170 A * 8/1984 Hanset
5,551,165 A * 9/1996 Turner et al.
6,393,872 B2 * 5/2002 Whah et al.
6,475,395 B1 * 11/2002 Schmit et al.

FOREIGN PATENT DOCUMENTS

| | | | |
|---|---|---|---|
| DE | 40 26 838 | A1 | 3/1992 |
| DE | 43 32 225 | A1 | 12/1994 |
| DE | 195 28 322 | A1 | 2/1997 |
| EP | 0 464 776 | A1 | 1/1992 |
| EP | 0 628 653 | A1 | 12/1994 |
| EP | 0 726 349 | A2 | 8/1996 |
| JP | 54-96266 | * | 7/1979 |

* cited by examiner

*Primary Examiner*—Frankie L. Stinson
(74) *Attorney, Agent, or Firm*—Laurence A. Greenberg; Werner H. Stemer; Ralph E. Locher

(57) ABSTRACT

An automatically controlled washing machine includes a washing liquid circulation system which drains washing liquid from the bottom of a laundry treatment space and, via a supply orifice, supplies the washing liquid again to the laundry treatment space. The supply orifice is configured such that a dynamic pressure is present in the circulating line during a pumping operation. The washing liquid circulation system has a sensor device which is sensitive to the dynamic pressure and transmits a signal for controlling a supply valve for fresh water as a function of the dynamic pressure. The sensor device also detects a static pressure present in the laundry treatment space and in the circulating line, when the circulating pump is switched off. The sensor device transmits a signal for executing safety measures when the static pressure exceeds a given safety level so that the washing machine is protected against overflowing.

7 Claims, 1 Drawing Sheet

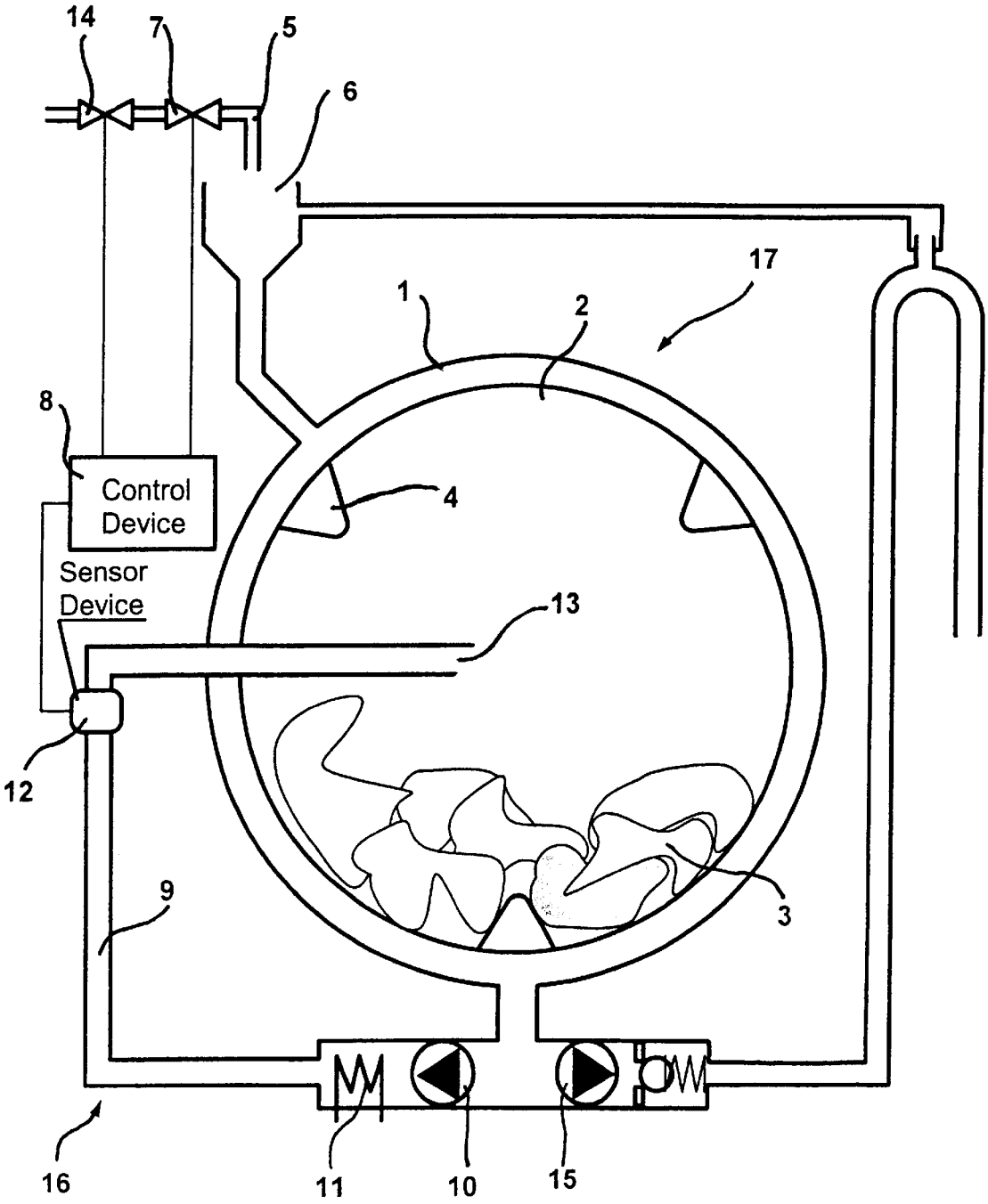
14
7
5
6
17
1
2
8
Control Device
4
Sensor Device
13
12
9
3
16
11
10
15

AUTOMATICALLY CONTROLLED WASHING MACHINE WITH OVERFLOW PROTECTION

CROSS-REFERENCE TO RELATED APPLICATION

This application is a continuation of copending International Application No. PCT/EP00/11040, filed Nov. 8, 2000, which designated the United States and was not published in English.

BACKGROUND OF THE INVENTION

FIELD OF THE INVENTION

The invention relates to an automatically controlled washing machine with at least one fresh-water line and with a washing liquid circulation system which drains a washing liquid from the bottom of a laundry treatment space and supplies the washing liquid via a circulating line again to the laundry treatment space. A sensor device is provided on the pressure side of the circulating pump and is sensitive to a dynamic pressure and transmits, as a function of the dynamic pressure, a signal for controlling a supply valve for fresh water.

A washing machine of this type is known, for example, from Published, Non-Prosecuted German Patent Application No. DE 43 32 225 A1. This conventional washing machine has a washing liquid circulation system which drains the washing liquid from the bottom of a laundry treatment space and pumps the washing liquid via a circulating line back to the treatment space such that the washing liquid is supplied above the laundry located in the treatment space. The washing machine has at least one fresh-water delivery line which can be opened or closed by a controllable valve.

A sensor device is provided in the washing liquid circulation system. The sensor device is suitable for detecting a volume flow in the conveying direction of the pump, and the control device of the washing machine is configured in such a way that, in the event of a signal from the sensor device which indicates an absence of the volume flow, the valve is actuated in such a way that fresh water is supplied. In a preferred embodiment, the sensor device is coupled to the circulating line on the delivery side of the pump, and the supply orifice between the circulating line and the laundry treatment space is configured in such a way that, during the pumping mode, there is a dynamic pressure in the completely filled circulating line. The sensor device is correspondingly sensitive to this dynamic pressure and delivers to the control device of the washing appliance corresponding signals for opening and closing the valve of the fresh-water supply. The sensor device emits a positive signal when the washing liquid circulation system is completely filled and a dynamic pressure has been formed upstream of the supply orifice. When a positive signal is received, the control device shuts off the valve of the fresh-water supply. When the dynamic pressure is insufficient, the sensor device transmits a negative signal to the control device which causes the solenoid valve to open. The fresh-water supply is switched on and the water quantity that is needed is added. One disadvantage of this conventional washing machine is that, if various elements, for example the solenoid valve, fail, there are no safety measures installed which prevent an overflow of the washing machine.

Furthermore, the prior art discloses devices which detect that a defined water quantity in the laundry treatment space is exceeded and thereupon initiate safety measures, such as, for example, the switching-on of an emptying pump or the closing of an additional safety valve. The detection of this safety level is carried out, for example, via pressure switches or via sensors which are to be found behind an orifice present at an appropriately high point in the water ducting system.

SUMMARY OF THE INVENTION

It is accordingly an object of the invention to provide a washing machine which overcomes the above-mentioned disadvantages of the heretofore-known washing machines of this general type and which has a washing liquid circulation system, which in a simple and cost-effective way provides an overflow protection and is easy to maintain.

With the foregoing and other objects in view there is provided, in accordance with the invention, an automatically controlled washing machine, including:

a fresh-water line;

a water supply valve connected to the fresh-water line;

a laundry treatment space having a bottom region;

a washing liquid circulation system including a circulating pump, a circulating line and a sensor device;

a control device operatively connected to the sensor device;

the circulating pump having a pressure side, the sensor device being provided on the pressure side;

the circulating line being connected to the circulating pump and having a supply orifice formed therein, the supply orifice being configured such that the circulating pump provides a dynamic pressure in the circulating line when the circulating line is completely filled with the washing liquid during a pumping operation;

the washing liquid circulation system draining, with the circulating pump, the washing liquid from the bottom region of the laundry treatment space and, via the circulating line and the supply orifice, supplying the washing liquid again to the laundry treatment space above the bottom region;

the sensor device being sensitive to the dynamic pressure in the circulating line, and the sensor device transmitting to the control device a signal for controlling the water supply valve as a function of the dynamic pressure; and the sensor device further detecting a static pressure present in the laundry treatment space and in the circulating line when the circulating pump is switched off, and the sensor device transmitting to the control device a signal for executing a safety measure when the static pressure exceeds a given safety level.

In other words, an automatically controlled washing machine with at least one fresh-water line and with a washing liquid circulation system which discharges washing liquid from the bottom of a laundry treatment space and, via a supply orifice, supplies it again to the laundry treatment space from above via a circulating line by using a circulating pump, the supply orifice being configured in such a way that, during the pumping mode, a dynamic pressure occurs in the completely filled circulating line, the washing liquid circulation system having, furthermore, a sensor device which is provided on the delivery side of the circulating pump and which is sensitive to this dynamic pressure, the sensor device transmitting to a control device of the washing machine, as a function of the dynamic pressure, a signal for controlling a supply valve for fresh water, wherein a static pressure established in the laundry treatment space, and consequently also in the circulating line, when the circulating pump is switched off is likewise detected by the sensor device, and the sensor device transmits to the control device a signal for executing safety measures when the static pressure exceeds a presettable safety level.

As explained, the object of the invention is achieved in that a static pressure established in the laundry treatment space, and therefore also in the circulating line, when the circulating pump is switched off is likewise detected by the sensor device, and the sensor device of the control device transmits a signal for the implementation of safety measures when the static pressure exceeds a presettable safety level, the sensor device of the washing liquid circulation system at the same time assuming the functions of controlling the fresh-water supply and of overflow protection. This advantageously ensures a material-saving and cost-saving sensor configuration which, moreover, is particularly easy to maintain.

Advantageously, the fresh-water line has mounted in it an additional safety valve which, in the event of a corresponding sensor signal from the overflow protection according to the invention, is closed by the control device of the washing machine. This prevents the situation where, in the case of a defective solenoid valve, fresh water is supplied out of the fresh-water line into the laundry treatment space without the water flow being checked or controlled.

In a further advantageous embodiment of the invention, there is provided, as an additional safety measure, an emptying pump which can discharge washing liquid from the bottom region of the laundry treatment space. If there is too much water in the laundry treatment space, the emptying pump can be switched on via the control device of the washing machine.

In a simple embodiment, the sensor device is advantageously configured as a pressure switch. Pressure switches of this type are commercially available and are easy to install.

In an advantageous embodiment, the pressure switch has two contacts which react to differently preset pressure levels. The contact which is used for the measurement of the dynamic pressure for controlling the fresh-water supply is different from the contact used for the measurement of the static pressure of the water quantity in the water treatment space for the purpose of overflow protection.

Advantageously, and alternatively, a single contact for the measurement of the dynamic pressure and the static pressure is provided in the pressure switch. In this particularly simple embodiment, therefore, the sensor level for the activation of safety measures and that for closing the valve for the fresh-water supply has to be set only once at a fixed value.

It is particularly advantageous if the control device of the washing machine is programmed in such a way that the circulating pump is switched off at periodic time intervals for a predetermined period of time. This automatically ensures that the elements of the overflow protection check the water level in the laundry treatment space at regular intervals.

Other features which are considered as characteristic for the invention are set forth in the appended claims.

Although the invention is illustrated and described herein as embodied in an automatically controlled washing machine with an overflow protection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The single FIGURE is a diagrammatic illustration of an exemplary embodiment of the washing machine according to the invention.

DESCRIPTION OF THE PREFERRED EMBODIMENTS

Referring now to the single FIGURE in detail, there is shown a washing machine 17 which has, as a laundry treatment space 1, a tub, in which a washing drum 2 is horizontally mounted so that it can rotate. Laundry items 3 and baffles 4 for rearranging the laundry items 3 during the rotation of the washing drum 2 can be seen in the drum 2. The washing liquid (suds) is introduced into the laundry treatment space 1 via a fresh-water line 5 and a washing-agent container 6. A valve 7 which can be controlled by the control device 8 of the washing machine and located in the fresh-water line 5 serves for regulating the fresh-water supply. A washing liquid circulation system 16 causes the laundry items 3 to be constantly flooded with washing liquid and is connected to the bottom of the laundry treatment space 1. The washing liquid circulation system 16 has a circulating line 9, in which are provided a circulating pump 10 and a sensor device 12. The drained-off washing liquid is supplied to the laundry treatment space 1 again from above through a supply orifice 13 via the circulating line 9. An additional heating device 11 may be provided in the circulating line 9 on the delivery side of the circulating pump 10.

The sensor device 12 integrated in the washing liquid circulation system 16 is connected to the control device 8 of the washing machine 17. The control device 8 is suitable, inter alia, for opening and closing the valve 7 to the fresh-water supply. For reasons of overflow protection, the valve 7 may be preceded by a further safety valve 14 in the fresh-water line 5. It is also possible to mount on the bottom of the laundry treatment space 1 an additional emptying pump 15 which can discharge washing liquid outward from the tub 1. In possible embodiments, both the circulating pump 10 and the emptying pump 15 and also the safety valve 14 may be controlled by the control device 8 of the washing machine 17.

When the washing machine 17 is switched on, the washing drum 2 rotates, and the laundry items 3 are driven upward by the baffles 4 and fall down again. When the circulating pump 10 is switched on, the washing liquid dripping off from the laundry items 3 is pumped off from the laundry treatment space 1 at the bottom of the latter via the washing liquid circulation system 16. By virtue of the pumping capacity of the circulating pump 10, the water in the circulating line 9 is conveyed upward and, from there, is supplied to the laundry treatment space 1 again from above via the supply orifice 13. The supply orifice 13 is in this case configured in such a way that, with the circulating line 9 filled, the water backs up, with the result that a dynamic pressure is established in the circulating line 9. The sensor device 12 is sensitive to this dynamic pressure and, depending on the magnitude of the dynamic pressure, transmits a signal to the control device 8 of the washing machine 17 for opening or closing the valve 7 of the fresh-water line 5. If there is sufficient dynamic pressure, the valve 7 is closed, and if the circulating line 9 contains only a little washing liquid or no washing liquid at all the valve 7 is opened. The washing liquid provided in the laundry treatment space 1 is thereby restricted to the quantity absolutely necessary.

When the circulating pump 10 is switched off, the circulating line 9 is filled with the washing liquid present in the laundry treatment space 1. A static water pressure is thereby established in the circulating line 9, which rises with the height of the water level in the laundry treatment space 1 and is likewise detected by the sensor device 12. When this static pressure exceeds a presettable safety level, that is to say the static pressure corresponds to a critical water quantity in the laundry treatment space 1, the sensor device 12 transmits a signal to the control device 8 of the washing machine 17, whereupon the control device 8 initiates safety measures for overflow protection. The closing of an additional valve 14 in the fresh-water line 5 and/or the switching-on of the emptying pump 15 is provided as a safety measure. Thus, with the circulating pump 10 switched off, it is possible to ensure, through the use of the sensor device 12 integrated in the washing liquid circulation system 16, that the washing machine 17 does not overflow because of a technical defect, such as, for example, the functioning capacity of the valve 7.

Commercially available pressure switches which react both to dynamic pressure and to static pressure are appropriate as a sensor device 12. In one possible embodiment, such a pressure switch possesses two contacts for different pressure levels. It is consequently possible to set a different limit for closing the valve 7 for the dynamic pressure from that for the static pressure, the safety level of which will usually be above the value of the dynamic pressure. Nevertheless, with a suitable configuration, it may also be envisaged to manage with only one contact in the pressure switch for both types of pressure measurement.

The switching-off of the circulating pump 10 and the changeover of the limit-pressure necessary in the case of two-contact pressure switches 12 are usually carried out through the use of the central control device 8 of the washing machine 17. In a preferred embodiment of the present invention, the control device 8 regularly switches off the circulating pump 10 for short time periods, in which the functioning of the washing liquid circulation system 16 is interrupted and the sensor device 12 can initiate possible safety measures for overflow protection via the dynamic pressure occurring in the circulating line 9. The central control device 8 processes the signals delivered by the sensor device 12 and immediately brings about the closing of the safety valve 14 and/or the switching-on of the emptying pump 15.

Thus, by the circulating pump 10 being periodically switched off briefly, an overflow of the appliance during the washing operation can be efficiently prevented in a simple way.

We claim:

1. An automatically controlled washing machine, comprising:

a fresh-water line;

a water supply valve connected to said fresh-water line;

a laundry treatment space having a bottom region;

a washing liquid circulation system including a circulating pump, a circulating line and a sensor device;

a control device operatively connected to said sensor device;

said circulating pump having a pressure side, said sensor device being provided on said pressure side;

said circulating line being connected to said circulating pump and having a supply orifice formed therein, said supply orifice being configured such that said circulating pump provides a dynamic pressure in said circulating line when said circulating line is completely filled with the washing liquid during a pumping operation;

said washing liquid circulation system draining, with said circulating pump, the washing liquid from said bottom region of said laundry treatment space and, via said circulating line and said supply orifice, supplying the washing liquid again to said laundry treatment space above said bottom region;

said sensor device being sensitive to the dynamic pressure in said circulating line, and said sensor device transmitting to said control device a signal for controlling said water supply valve as a function of the dynamic pressure; and said sensor device further detecting a static pressure present in said laundry treatment space and in said circulating line when said circulating pump is switched off, and said sensor device transmitting to said control device a signal for executing a safety measure when the static pressure exceeds a given safety level.

2. The washing machine according to claim 1, including a safety valve connected to said fresh-water line, said safety valve executing the safety measure by closing off said fresh water line.

3. The washing machine according to claim 1, including an emptying pump operatively connected to said control device, said emptying pump executing the safety measure by being activated and draining the washing liquid from said bottom region of said laundry treatment space.

4. The washing machine according to claim 1, wherein said sensor device is a pressure switch.

5. The washing machine according to claim 4, wherein said pressure switch has two contacts for differently setting a magnitude for the dynamic pressure and a magnitude for the static pressure.

6. The washing machine according to claim 4, wherein said pressure switch has a single contact for an identical setting for a magnitude for the dynamic pressure and a magnitude for the static pressure.

7. The washing machine according to claim 1, wherein said control device periodically switches off said circulating pump for a given time period.

* * * * *